US010998117B2

(12) United States Patent
Kobayashi et al.

(10) Patent No.: US 10,998,117 B2
(45) Date of Patent: May 4, 2021

(54) WIRE-WOUND COIL COMPONENT AND METHOD FOR PRODUCING WIRE-WOUND COIL COMPONENT

(71) Applicant: Murata Manufacturing Co., Ltd., Kyoto-fu (JP)

(72) Inventors: Kohei Kobayashi, Nagaokakyo (JP); Yoshifumi Maki, Nagaokakyo (JP); Takuya Ishida, Nagaokakyo (JP); Shinya Hirai, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/802,581

(22) Filed: Nov. 3, 2017

(65) Prior Publication Data

US 2018/0158591 A1 Jun. 7, 2018

(30) Foreign Application Priority Data

Dec. 1, 2016 (JP) ..... JP2016-233818

(51) Int. Cl.
*H01F 27/28* (2006.01)
*H01F 27/29* (2006.01)
(Continued)

(52) U.S. Cl.
CPC ..... *H01F 27/28* (2013.01); *H01F 5/04* (2013.01); *H01F 27/2828* (2013.01);
(Continued)

(58) Field of Classification Search
CPC . H01F 27/28; H01F 5/04; H01F 27/29; H01F 17/045; H01F 17/04; H01F 27/306;
(Continued)

(56) References Cited

U.S. PATENT DOCUMENTS 6,087,921 A * 7/2000 Morrison ..... H01F 27/292 336/192
6,144,280 A * 11/2000 Amada ..... H01F 17/045 29/602.1
(Continued)

FOREIGN PATENT DOCUMENTS

CN 1292559 A 4/2001
CN 1755847 A 4/2006
(Continued)

OTHER PUBLICATIONS

An Office Action mailed by the Chinese Patent Office dated Mar. 5, 2019, which corresponds to Chinese Patent Application No. 201710951701.7 and is related to U.S. Appl. No. 15/802,581 with English language translation.
(Continued)

*Primary Examiner* — Tszfung J Chan

(74) *Attorney, Agent, or Firm* — Studebaker & Brackett PC

(57) ABSTRACT

A wire-wound coil component includes a core having a spool and a flange, a wire wound around the spool, and an outer electrode to which an end portion of the wire is electrically coupled. The flange has a lateral surface and a bottom surface. The outer electrode has a metal thin-film section in contact with the lateral surface and a thick-film electrode section which is a metal composite film in contact with the bottom surface.

13 Claims, 6 Drawing Sheets

(51) Int. Cl.
*H01F 5/04* (2006.01)
*H01F 41/06* (2016.01)
*H01F 17/00* (2006.01)

(52) U.S. Cl.
CPC ..... *H01F 27/292* (2013.01); *H01F 41/06* (2013.01); *H01F 2017/0093* (2013.01)

(58) Field of Classification Search
CPC .. H01F 27/2828; H01F 27/24; H01F 27/2823; H01F 2017/0093; H01F 27/292; H01F 27/263
USPC ..... 336/83, 90, 180, 184, 192, 196, 200
See application file for complete search history.

(56) References Cited

U.S. PATENT DOCUMENTS

| | | | | | |
|---|---|---|---|---|---|
| 6,154,112 | A * | 11/2000 | Aoba | H01F 27/292 | 336/185 |
| 6,437,676 | B1 * | 8/2002 | Takeda | H01F 17/062 | 336/192 |
| 2003/0117258 | A1 | 6/2003 | Kim et al. | | |
| 2005/0052267 | A1 * | 3/2005 | Singu | H01F 17/045 | 336/83 |
| 2006/0071749 | A1 * | 4/2006 | Aoki | H01F 17/045 | 336/83 |
| 2009/0058591 | A1 * | 3/2009 | Nakada | H01F 1/344 | 336/221 |
| 2013/0194060 | A1 * | 8/2013 | Nakada | H01F 1/33 | 336/192 |
| 2017/0287634 | A1 * | 10/2017 | Baba | H01F 27/29 | |

FOREIGN PATENT DOCUMENTS

| | | | | | |
|---|---|---|---|---|---|
| JP | S6385078 | A | | 4/1988 | |
| JP | S6433084 | A | | 2/1989 | |
| JP | 03145706 | A | * | 6/1991 | |
| JP | 09190942 | A | * | 7/1997 | H01F 27/027 |
| JP | 2000030952 | A | * | 1/2000 | H01F 27/292 |
| JP | 2002-170717 | A | | 6/2002 | |
| JP | 2003017336 | A | * | 1/2003 | |
| JP | 2003017336 | A | | 1/2003 | |
| JP | 2003-197404 | A | | 7/2003 | |
| JP | 2004-040084 | A | | 2/2004 | |
| JP | 200557104 | A | | 3/2005 | |
| JP | 2006100748 | A | | 4/2006 | |
| JP | 2008-210978 | A | | 9/2008 | |
| JP | 2008210978 | A | * | 9/2008 | |
| JP | 2008-300607 | A | | 12/2008 | |
| JP | 2011-109020 | A | | 6/2011 | |

OTHER PUBLICATIONS

An Office Action; "Notification of Reasons for Refusal," mailed by the Japanese Patent Office dated Mar. 19, 2019, which corresponds to Japanese Patent Application No. 2016-233818 and is related to U.S. Appl. No. 15/802,581; with English language translation.
An Office Action; "Notification of Reasons for Refusal," Mailed by the Japanese Patent Office dated Aug. 27, 2019, which corresponds to Japanese Patent Application No. 2016-233818 and is related to U.S. Appl. No. 15/802,581; with English language translation.
An Office Action; "Notification of Reasons for Refusal," mailed by the Japanese Patent Office dated Oct. 6, 2020, which corresponds to Japanese Patent Application No. 2019-213845 and is related to U.S. Appl. No. 15/802,581 with English language translation.

* cited by examiner

LASER PROCESSING, EARLY

LASER PROCESSING, FINISHED

PLATING, EARLY

PLATING, FINISHED

LASER PROCESSING, EARLY

LASER PROCESSING, FINISHED

PLATING, EARLY

PLATING, FINISHED

WIRE-WOUND COIL COMPONENT AND METHOD FOR PRODUCING WIRE-WOUND COIL COMPONENT

CROSS REFERENCE TO RELATED APPLICATIONS

This application claims benefit of priority to Japanese Patent Application 2016-233818 filed Dec. 1, 2016, the entire content of which is incorporated herein by reference.

TECHNICAL FIELD

The present disclosure relates to a wire-wound coil component and a method for producing a wire-wound coil component. In particular, the present disclosure relates to the structure of an outer electrode of a wire-wound coil component.

BACKGROUND

Wire-wound coil components typically have outer electrodes, and these outer electrodes are usually formed by coating flanges of a core with a conductive paste containing metal and glass, baking the coatings into base electrodes, and plating the base electrodes to form upper electrodes (e.g., see Japanese Unexamined Patent Application Publication Nos. 2008-210978 and 2011-109020).

A proposed alternative to these existing methods is to form the outer electrodes by plating alone (Japanese Unexamined Patent Application Publication No. 2004-40084). This method, for fabricating a multilayer coil component that has a ceramic body and inner electrodes therein for example, includes exposing multiple end portions of the inner electrodes along an edge of the ceramic body, with the exposed end portions close to each other, exposing dummy terminals called anchor tabs along the same edge of the ceramic body as the end portions of the inner electrodes, with the exposed portions of the dummy terminals close to each other, and electrolessly plating the ceramic body. Layers of the plating metal grow from the exposed end portions of the inner electrodes and anchor tabs, forming outer electrodes.

SUMMARY

Methods in which base electrodes are formed by applying conductive paste, such as that disclosed in Japanese Unexamined Patent Application Publication No. 2008-210978, offer few options for the shape of the resulting outer electrodes. For example, if the base electrodes are formed by dipping a lateral surface of rectangular flanges in conductive paste, the conductive paste not only covers the lateral surface of each flange but also reaches the four neighboring surfaces. The resulting outer electrodes will therefore each extend over five surfaces. A particularly important factor is that the base electrodes are thick films. They are thicker than metal thin films, formed by a technique such as plating, sputtering, or vapor deposition, and therefore have great impact on the outer dimensions of the component.

A solution is to form outer electrodes with base electrodes therein only on the bottom side of the flanges, i.e., the side facing the substrate onto which the component is mounted, as in Japanese Unexamined Patent Application Publication No. 2011-109020. This reduces the thickness of the portions of the outer electrodes sticking out and reaching the four surfaces adjacent to the bottom surface of the flanges, including the lateral surfaces of the flanges, making the area the wire-wound coil component occupies on the principal surface of the substrate (footprint) smaller. The usage of wire-wound coil components, however, can change. They can get smaller in size, and their future applications can include use under harsh conditions, such as operation in automotive equipment. In such situations, soldering only on the bottom side of the flanges may be insufficient for secure bonding between the wire-wound coil component and the substrate onto which it is mounted.

In the method described in Japanese Unexamined Patent Application Publication No. 2004-40084, the resulting outer electrodes are metal thin films formed by plating. This technology, however, requires that the component have electrodes, including anchor tabs, inside the body (core), and therefore is difficult to apply to wire-wound coil components, which have a spiral of wire around a core instead of electrodes inside the core.

Accordingly, it is an object of the present disclosure to propose a wire-wound coil component that combines a reduced footprint and strengthened bonding with a substrate and a method for the production of this wire-wound coil component.

According to one embodiment of the present disclosure, a wire-wound coil component includes a core having a spool and a flange connected to an end portion of the spool, a wire wound around the spool, and an outer electrode to which an end portion of the wire is electrically coupled. The flange has a lateral surface and a bottom surface. The outer electrode has a metal thin-film section in contact with the lateral surface and a thick-film electrode section which is a metal composite film in contact with the bottom surface.

The term metal thin-film section refers to an electrode section formed by, for example, plating, sputtering, or vapor deposition. The term metal composite film refers to a film obtained by applying conductive paste and hardening it by firing (baking), heat curing, drying, or any other technique. Some types of conductive pastes contain metal particles and glass, other types contain metal particles and thermosetting resin, and yet other types are also available. The metal thin-film and thick-film electrode sections can therefore be differentiated not only by the process of formation but also by composition. The former is a film of a conductor, such as metal, an alloy, or an intermetallic compound, whereas the latter is a film of a mixture of a conductor, such as metal, and a binder, such as glass or resin.

In this structure, the thick-film electrode section does not extend to the lateral surface side of the flange, and this gives a smaller footprint to the wire-wound coil component on the substrate onto which it is mounted. The entire outer electrode, however, not only lies on the bottom surface side but also extends to the lateral surface side of the flange. This helps, when the coil component is soldered onto a substrate, a solder fillet form along the lateral surface of the flange, strengthening the bonding between the wire-wound coil component and the substrate. As a result, the wire-wound coil component combines a reduced footprint and strengthened bonding with a substrate.

In the above structure, a part of the lateral surface being in contact with the metal thin-film section may have a low-resistance region. The low-resistance region provides a starting point for the metal thin film to grow, making the formation of the metal thin film efficient. The term low-resistance region as used herein refers to a region of the core in which the electrical resistance is lower than in the rest, such as the flange or the spool.

In the above structure, the flange may be made of a ceramic material containing a metal oxide, and the low-resistance region may contain a metal resulting from reduction of a part of the metal oxide. In this case, the low-resistance region is an altered form of the material for the flange and therefore requires no complicated process to form. The reduced metal can be a simple metal or a component of an alloy or intermetallic compound, and can also be a component of a metal oxide in which the metal has a smaller valency than in the original metal oxide.

In the above structure, the surface side of the low-resistance region may be a reoxidized coating and the reoxidized coating contains a metal oxide resulting from reoxidation of the metal. The reoxidized coating controls the reoxidation of the reduced metal in the low-resistance region, preventing the material for the flange from altering more than necessary.

In the above structure, the flange may be made of a ceramic material containing a metal oxide, and a part of the lateral surface being in contact with the metal thin-film section may have a reduced layer and the reduced layer contains a metal resulting from reduction of a part of the metal oxide. The reduced layer, formed by the alteration of the material for the flange, allows for selective and efficient formation of the metal thin-film section.

In the above structure, the end portion of the wire may be connected to the outer electrode above the bottom surface. This reduces, during the joining of the end portion of the wire to the outer electrode, by thermocompression bonding for example, the amount of heat or external force that transmits to the flange by making it absorbed by the thick-film electrode section.

In the above structure, the thick-film electrode section may be covered with the metal thin-film section. This helps form an outer electrode that is continuous from the lateral surface to the bottom surface of the flange.

In the above structure, the bottom surface may be a surface that faces a substrate and the lateral surface may be a surface perpendicular to the substrate when the coil component is mounted onto the substrate. This leads to a smaller footprint of the wire-wound coil component on the substrate onto which it is mounted. When it is stated herein that a surface faces or comes perpendicular to a substrate, it means that the surface faces or comes perpendicular to the principal surface of the substrate.

In the above structure, the lateral surface may be opposite to a connection surface at which the flange is connected to the spool, and the bottom surface may be positioned between the lateral surface and the connection surface. This leads to a smaller footprint of the wire-wound coil component when the coil component is of a horizontal type.

In the above structure, the flange may be made of a ferrite material. In this case, the core does not need to have a complicated structure in order for the outer electrode to be thin.

According to another embodiment of the present disclosure, a method for producing a wire-wound coil component includes: A, preparing a core that has a spool and a flange connected to an end portion of the spool; B, forming a thick-film electrode section which is a metal composite film on a bottom surface by applying a conductive paste to the bottom surface and firing or heat-curing the paste; and C, forming a metal thin-film section on a lateral surface.

In this method, the thick-film electrode section is not formed on the lateral surface side of the flange, and this gives the wire-wound coil component a smaller footprint. The entire outer electrode is, however, formed not only on the bottom surface side but also on the lateral surface side of the flange. This helps, when the wire-wound coil component is soldered onto a substrate, a solder fillet form along the lateral surface of the flange, strengthening the bonding between the coil component and the substrate. This method therefore gives a wire-wound coil component that combines a reduced footprint and strengthened bonding with a substrate.

According to another embodiment of the present disclosure, a method for producing a wire-wound coil component includes: A, preparing a core that is made of a ceramic material containing a metal oxide and has a spool and a flange connected to an end portion of the spool; B, forming a thick-film electrode section which is a metal composite film on a bottom surface by applying a conductive paste to the bottom surface and firing the paste; C, forming a low-resistance region by localized heating of a lateral surface; and D, forming a metal thin-film section that covers the thick-film electrode section and the low-resistance region by plating.

This method, besides being advantageous in the same way as the above one, does not need, on the bottom surface side of the flange, pretreatment for the formation of the outer electrode. The manufacturer can form the outer electrode without affecting the strength, reliability, or adhesion, to the outer electrode, of the bottom surface of the flange. Furthermore, the low-resistance region provides a starting point for the metal thin-film section to grow, making the formation of the metal thin-film section efficient. It should be noted that the low-resistance region is formed after the thick-film electrode section. Otherwise the firing for the formation of the thick-film electrode section would further oxidize the low-resistance region, increasing the electrical resistance there, which would interfere with the subsequent formation of the metal thin-film section. Moreover, simultaneous formation of the metal thin-film section, an electrode formed by plating, on the thick-film electrode section and on the low-resistance region makes the formation of the outer electrode simpler.

The above method may further include: E, winding a wire around the spool; and F, joining an end portion of the wire to the thick-film electrode section by thermocompression bonding the bottom surface. In this arrangement, the heat and external force applied during the thermocompression bonding of the end portion of the wire to the metal thin-film section is absorbed by the thick-film electrode section, and little transmits to the flange. The impact on the strength, reliability, and adhesion, to the outer electrode, of the bottom surface is therefore further reduced.

Other features, elements, characteristics and advantages of the present disclosure will become more apparent from the following detailed description of some embodiments of the present disclosure with reference to the attached drawings.

DETAILED DESCRIPTION

Figure 1:
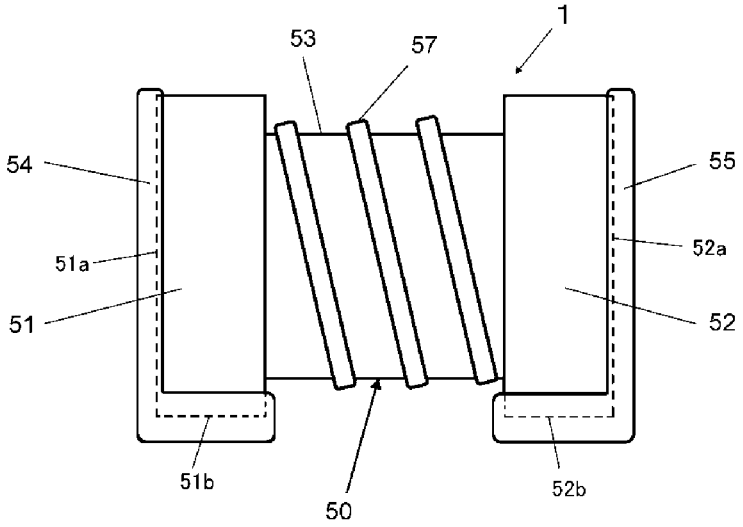
FIG. 1 is a front view of a first example of a wire-wound coil component according to an embodiment of the present disclosure-.
Figure 2:
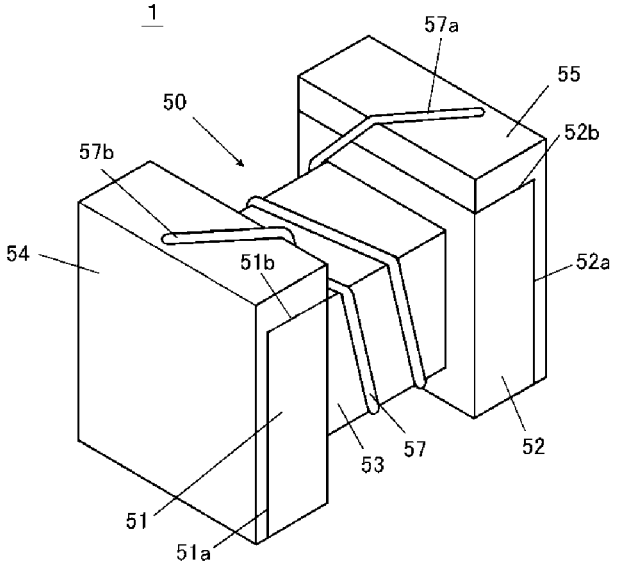
FIG. 2 is a perspective view of the wire-wound coil component in FIG. 1 positioned upside down.

FIGS. 1 and 2 are front and perspective views, respectively, of a surface mount inductor 1 as a first example of a wire-wound coil component according to an embodiment of the present disclosure. In FIG. 2, the inductor 1 is upside down. As illustrated in FIGS. 1 and 2, the inductor 1 has a core 50, a wire 57, and outer electrodes 54 and 55. The core 50 has a spool 53 and two flanges 51 and 52 connected to the two end portions of the spool 53. The wire 57 is wound around the spool 53. To the outer electrodes 54 and 55 are electrically coupled the end portions of the wire 57. All drawings, including FIG. 1, are schematic. In actual products, the size of each element, such as dimensions and aspect ratios, may be different.

Figure 3:
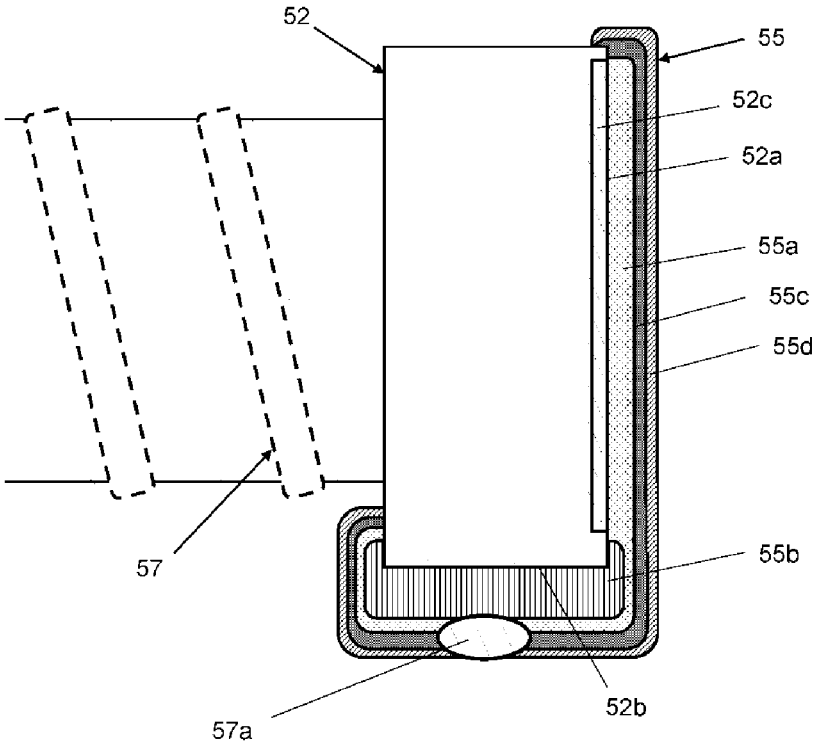
FIG. 3 is a partial enlarged cross-sectional view of the wire-wound coil component in FIG. 1.

The core 50 is made of a ceramic material containing a metal oxide, such as Ni—Zn ferrite or Ni—Cu—Zn ferrite. FIG. 3 is a partial enlarged cross-sectional view of the wire-wound coil component in FIG. 1, illustrating the flange 52 of the core 50 and its surroundings. The flange 51 of the core 50 and its surroundings have the same structure as in FIG. 3, although not illustrated or described. As illustrated in FIG. 3, the flange 52 has a lateral surface 52*a* and a bottom surface 52*b*. When the coil component is mounted onto a substrate (not illustrated), the bottom surface 52*b* faces the substrate, and the lateral surface 52*a* comes perpendicular to the substrate. The lateral surface 52*a* is, furthermore, opposite a connection surface of the flange 52, the surface at which the flange 52 is connected to the spool 53, and the bottom surface 52*b* is positioned between the lateral surface 52*a* and the connection surface. That is, the inductor 1 is what is called a horizontal inductor, with the spool 53 extending parallel to the substrate onto which the inductor 1 is mounted.

The wire 57 is a metal wire, such as a Cu, Ag, or Au wire, and is coated with a resin, such as polyurethane, polyesterimide, or polyamide-imide, for insulation. When the inductor 1 is mounted onto a substrate, the axis of winding of the wire 57 comes parallel to the substrate. As illustrated in FIG. 3, an end portion 57*a* of the wire 57 is electrically coupled to the outer electrode 55, by thermocompression bonding, on the side where the bottom surface 52*b* of the flange 52 is located. The other end portion 57*b* of the wire 57 is electrically coupled to the outer electrode 54 likewise, on the side where the bottom surface 51*b* of the flange 51 is located (see FIG. 2).

The outer electrodes 54 and 55 are, as illustrated in FIG. 1, substantially L-shaped electrodes covering the lateral and bottom surface sides of the flanges 51 and 52 when viewed from the front. As in FIG. 3, the outer electrode 55 has a metal thin-film section 55*a* in contact with the lateral surface 52*a*, a base electrode section (thick-film electrode section) 55*b* in contact with the bottom surface 52*b*, and first and second coatings 55*c* and 55*d* covering the metal thin-film section 55*a* and base electrode section 55*b*. The metal thin-film section 55*a* is a thin film of metal formed by a plating process as described hereinafter, in which low-resistance regions 43 provide starting points for growth, and is made of a metallic material with low electrical resistance, such as Cu, Au, or Ag. The base electrode section 55*b* is a thick film that contains a metal with low electrical resistance, such as Ag, Cu, or Au, and glass, such as silica. The first and second coatings 55*c* and 55*d* are, for example, thin films of Ni and Sn, respectively, formed separately by plating, and improve the corrosion resistance and wettability of the outer electrode 55. Ni and Sn are not the only possible materials for the first and second coatings 55*c* and 55*d*. Each of these coatings may contain Cu, Au, and/or Ag besides Ni or Sn, and can even be made of an alloy, an intermetallic compound, or any similar material containing these metals.

As can be seen from the foregoing, the outer electrode 55 of the inductor 1 is thinner on the lateral surface 52*a* side than on the bottom surface 52*b* side, on which the base electrode section 55*b* is located, because on the lateral surface 52*a* of the flange 52 is its metal thin-film section 55*a*, which is thinner than a thick film, and its base electrode section 55*b* does not reach there. The inductor 1 therefore has a smaller footprint than existing ones on the substrate onto which it is mounted, as long as it is mounted in an appropriate orientation, with the bottom surface 52*b* facing the substrate and the lateral surface 52*a* perpendicular to the substrate.

Figure 4:
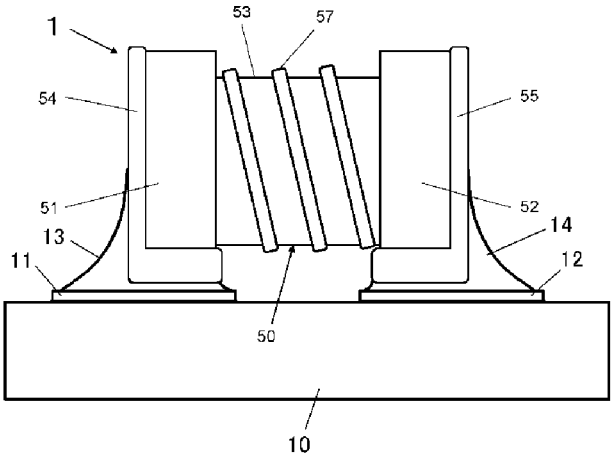
FIG. 4 is a front view of the wire-wound coil component in FIG. 1 mounted on a substrate.

The outer electrodes 54 and 55 of the inductor 1, furthermore, lie not only on the bottom surface 51*b*, 52*b* side but also on the lateral surface 51*a*, 52*a* side of the flanges 51 and 52. As illustrated in FIG. 4, this helps, when the inductor 1 is mounted onto a substrate 10 by soldering to lands 11 and 12, solder fillets 13 and 14 form along the lateral surfaces 51*a* and 52*a*. As a result, the inductor 1 is bonded to the substrate 10 more securely than would be if it were soldered only on the bottom surface 51*b*, 52*b* side.

It should be noted that the lateral surface 52*a*, in contact with the metal thin-film section 55*a*, of the inductor 1 has a reduced layer 52*c*. The reduced layer 52*c* includes low-resistance regions 43 (not illustrated in FIG. 3) that contain a reduced metal oxide. The low-resistance regions 43 have a lower electrical resistance than the rest of the flange 52 and the spool 53 (core 50). The metal thin-film section 55*a*, in contact with the lateral surface 52*a*, of the inductor 1 is formed using these low-resistance regions 43. A formation method can be as follows.

Figure 5A:
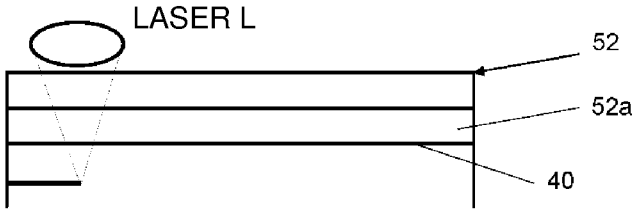
FIGS. 5A to 5C are side views of a flange irradiated with a laser on its lateral surface.
Figure 5B:
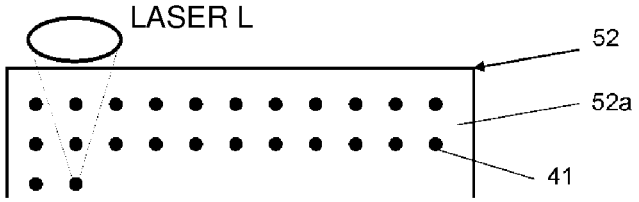
Figure 5C:
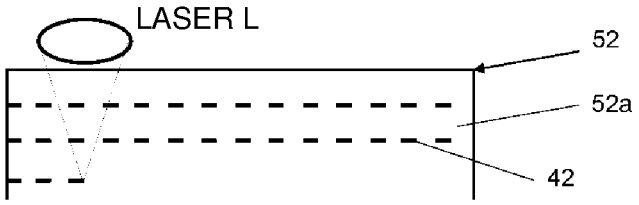

FIGS. 5A to 5C illustrate irradiation of the lateral surface 52*a* of the flange 52 with a laser L preliminary to the formation of the metal thin-film section 55*a* on the lateral surface 52*a*. In FIG. 5A, the laser L is scanning over the lateral surface 52*a* in the horizontal direction in the drawing, continuously emitting a beam (or the core 50 is moving in the horizontal direction in the drawing). The direction of scanning is not critical and can be vertical in the drawing, and the laser can even zigzag or circle around. Irradiation with the laser L creates many linear marks 40 on the lateral surface 52*a*. Although the linear marks 40 in FIG. 5A are spaced vertically in the drawing, the linear marks 40 may alternatively be created densely, overlapping each other. In FIG. 5B, irradiation with the laser L is in a polka dot pattern. This creates many dispersed dot marks 41 on the lateral surface 52*a*. FIG. 5C illustrates irradiation with the laser L in a broken-line pattern, which creates many line-segment marks 42 on the lateral surface 52*a*. In all of these cases, it is desired that the portion of the lateral surface 52*a* in which the metal thin-film section 55*a* is to be formed be evenly irradiated with the laser L.

FIGS. 6A to 6D schematically illustrate an example of a process of the formation of the metal thin-film section 55*a*, particularly one in which the lateral surface 52*a* of the flange 52 is irradiated with a laser L in a pattern of equally spaced lines.

Figure 6A:
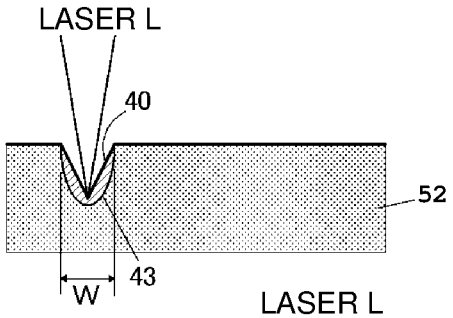
FIGS. 6A to 6D are cross-sectional diagrams illustrating a process of the formation of an outer electrode.

First, as in FIG. 6A, the lateral surface 52*a* of the flange 52 is irradiated with a laser within the portion in which the outer electrode is to be formed. This creates, on the lateral surface 52*a* of the flange 52, a laser mark 40 having a substantially V- or U-shaped cross-section. Although in FIG. 6A the laser L is focused to a particular point, the laser L may hit an area. The laser melts and solidifies the surface of the flange 52, leaving the laser mark 40 as a scar. The degree of alteration is the largest at the center of the spot, where the energy of the laser peaks, hence the substantially V- or U-shaped cross-section of the laser mark 40. Around the laser mark 40 is a low-resistance region 43, which includes the inner walls of the mark. The low-resistance region 43 is an altered form of the ceramic material of which the flange 52 is made (ferrite), and has a lower electric resistance than the ceramic material. Specifically, if the flange 52 (core 50) is made of Ni—Zn ferrite, which contains an oxide of Fe, Ni, and Zn, the low-resistance region 43 contains a reduced form of the metal oxide (more specifically, part of Fe out of the ferrite) resulting from laser irradiation, possibly together with reduced Ni and/or Zn. If the flange 52 (core 50) is a piece of Ni—Cu—Zn ferrite, which contains an oxide of Fe, Ni, Cu, and Zn, the low-resistance region 43 contains a reduced form of the metal oxide (more specifically, Fe and/or Cu out of the ferrite) resulting from laser irradiation, possibly together with reduced Ni and/or Zn. Such metal(s), reduced from a metal oxide, exists in the low-resistance region 43 in the form of, for example, a simple metal, a component of an alloy or intermetallic compound, or a component of a metal oxide in which the metal(s) has a smaller valency than in the original metal oxide, thereby giving the low-resistance region 43 an electric resistance lower than that in the rest of the core 50, in which the metal(s) is basically present in oxide form. The dimensions of the low-resistance region 43, such as depth and width, can be changed by adjusting the laser processing parameters, such as energy and the range of exposure.

Figure 6B:
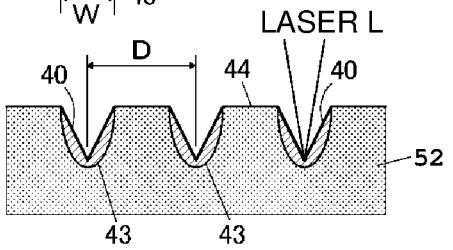

Then, as in FIG. 6B, laser irradiation is repeated to create multiple laser marks 40 with a distance D therebetween on the lateral surface 52*a* of the flange 52. In the illustrated process, the center-to-center distance D between the projected spots of two pulses of laser light is longer than the width W of the low-resistance regions 43 (e.g., the mean of the diameters of the laser marks 40, or the lengths of the marks 40 as measured in the direction in which they are repeated). Thus, there are insulating regions 44 between the laser marks 40 besides the low-resistance regions 43. In the insulating portions 44, the ceramic material of which the flange 52 is made is exposed as it is. The reduced layer 52*c* is a region that includes multiple low-resistance regions 43 formed in this way, and may include insulating regions 44 (regions in which the electric resistance is not lower than in the rest of the core 50) adjacent to the low-resistance regions 43.

Figure 6C:
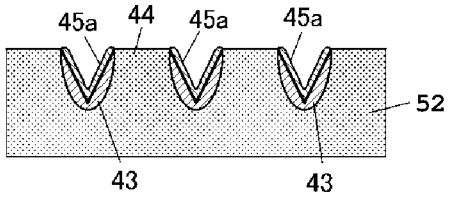

Then, as in FIG. 6C, the core 50, including the flange 52 given the laser-formed low-resistance regions 43, is immersed in an electroplating bath. Illustrated is an early stage of plating. In the low-resistance regions 43, in which the electrical resistance is lower than in the rest (insulating regions 44), the current density is lower than in the rest. The metal deposits 45*a* are therefore only present on the surfaces of the low-resistance regions 43, not yet on the insulating regions 44. At this stage, therefore, the continuous metal thin-film section 55*a* has yet to be completed.

Figure 6D:
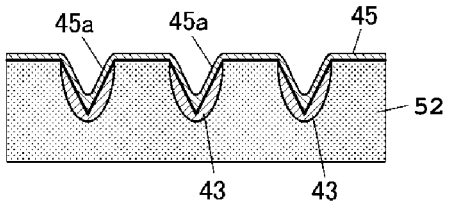

FIG. 6D illustrates finished electroplating. As the plating process continues, a layer of the plating metal grows around the metal deposits 45*a* on the low-resistance regions 43, expanding to reach the insulating regions 44, which are adjacent to the low-resistance regions 43. Plating is continued until the adjacent metal deposits 45*a* join, forming a continuous metal thin-film section 55*a* on the lateral surface 52*a*. Since the plating metal accumulates faster on the reduced layer 52*c*, formed by laser irradiation, than on the rest of the flange 52, it forms a layer selectively on the reduced layer 52*c* without strict control of the duration of plating. The time to completion and thickness of the metal thin-film section 55*a* can be controlled by adjusting the duration of plating or the voltage or current for plating.

Including this process of the formation of the metal thin-film section 55*a*, a method for the production of the inductor 1 is as follows.

First, a core 50 is prepared. The core 50 is made of a ceramic material containing a metal oxide, and has a spool 53 and two flanges 51 and 52 connected to the two end portions of the spool 53.

Then, a conductive paste containing metal and glass is applied to the portion of the flange 52 that is to provide the bottom surface 52*b*, and the resulting coating is fired to form a base electrode section 55*b*. The application and firing of the conductive paste can be done by a known method. For example, a resin containing an Ag powder and a glass frit is applied to the bottom surface 52*b* of the flange 52 by screen printing, dipping, ink jetting, or any other technique, and the resulting coating is fired. If the conductive paste contains metal and a thermosetting resin, the base electrode section 55*b* can be formed by heating the applied coating of the conductive paste at a temperature at which the thermosetting resin cures.

Then, a reduced layer 52*c* including low-resistance regions 43 is formed by localized heating of the portion of the flange 52 that is to provide the lateral surface 52*a*, using the above-described laser irradiation for example.

Then, a metal thin-film section 55*a* is formed to cover the base electrode section 55*b* and the low-resistance regions 43 (reduced layer 52*c*), by the above-described plating process for example.

Through this, an outer electrode 55 is formed on the core 50. In this method, the base electrode section 55*b* is not formed on the lateral surface 52*a* side of the flange 52, and this gives the inductor 1 a smaller footprint. The entire outer electrode 55 is, however, formed not only on the bottom surface 52*b* side but also on the lateral surface 52*a* side of the flange 52. This helps, when the inductor 1 is soldered onto a substrate, a solder fillet is formed along the lateral surface 52*a*, strengthening the bonding between the inductor 1 and the substrate. On the bottom surface 52*b* side of the flange 52, moreover, no pretreatment is needed for the formation of the outer electrode 55. This means that the manufacturer can form the outer electrode 55 without affecting the strength, reliability, or adhesion, to the outer electrode 55, of the bottom surface 52*b*. Furthermore, the low-resistance regions 43 provide starting points for the metal thin-film section 55*a* to grow, making the formation of the metal thin-film section 55*a* efficient. It should be noted that the low-resistance regions 43 are formed after the base electrode section 55*b*. Otherwise the firing for the formation of the base electrode section 55*b* would further oxidize the low-resistance regions 43, increasing the electrical resistance there, which would interfere with the subsequent formation of the metal thin-film section 55*a*.

In this method, furthermore, the base electrode section 55*b* is covered with the metal thin-film section 55*a*, and this helps form an outer electrode 55 that is continuous from the lateral surface 52*a* to the bottom surface 52*b* of the flange 52. The metal thin-film section 55*a* may optionally be covered with first and second coatings 55*c* and 55*d* for improved corrosion resistance and wettability of the outer electrode 55.

Then a wire 57 is wound around the spool 53, and an end portion 57*a* of the wire 57 is joined by thermocompression bonding to the second coating 55*d* on the side where the portion of the flange 52 that is to provide the bottom surface 52*b* is located, completing the inductor 1. The joined end portion 57*a* of the wire 57 may penetrate through the second coating 55*d*, first coating 55*c*, and metal thin-film section 55*a*, reaching the base electrode section 55*b*. This makes the end portion 57*a* of the wire 57 connected to the outer electrode 55 on the bottom surface 52*b* side, where the base electrode section 55*b* is located. In this form of connection, the heat and external force applied during the thermocompression bonding of the end portion 57*a* of the wire 57 to the metal thin-film section 55*a* is absorbed by the base electrode section 55*b*, and little heat and external force transmits to the flange 52. The impact on the strength, reliability, and adhesion, to the outer electrode 55, of the bottom surface 52*b* is therefore further reduced.

Experiment

The following describes an experiment that actually formed the outer electrodes 54 and 55 of an inductor 1.

(1) A Ni—Cu—Zn ferrite core 50 was irradiated with a laser scanning back and forth, forming a reduced layer 52*c* including low-resistance regions 43. The processing parameters were as in the table below. According to the inventors' research, however, the wavelength of the laser is not critical as long as it is approximately in the range of, for example, 532 nm to 10620 nm. The pitch represents the center-to-center distance between the projected spots of going and return pulses of laser light.

TABLE 1

| Laser processing parameters | |
|---|---|
| Wavelength | 1064 nm (YVO4) |
| Output power | 14 A |
| Scan speed | 200 mm/s |
| Q switch frequency | 20 kHz |
| Pitch | 30 μm |
| Spot diameter | 70 μm |
| Energy density | 1 J/sec |

(2) The laser-irradiated core 50 was electroplated, by barrel plating, under the conditions given in the table below.

TABLE 2

| Plating conditions | |
|---|---|
| Plating bath | Copper pyrophosphate bath |
| Number of revolutions [rpm] | 24 rpm |
| Current [A] | 12 A |
| Temperature [° C.] | 55° C. |
| Duration | 8 min |

Plating under the above conditions gave a good metal thin-film section 55*a* of Cu with a mean thickness of approximately 2 μm on the lateral surface 52*a* of the flange 52. A Ni—Zn ferrite core 50 gave similar results. Solution baths other than a copper pyrophosphate bath can also be used, such as a copper sulfate bath and a copper cyanate bath.

Evaluation

Then, the condition of the laser-formed reduced layer 52*c* (low-resistance regions 43) was evaluated by determining the valency of Fe, Cu, and Zn on the surface of a laser-irradiated sample of Ni—Cu—Zn ferrite and an unirradiated sample by XPS (x-ray photoelectron spectroscopy) and conversion electron yield K-edge XAFS (x-ray absorption fine structure) of Fe, Cu, and Zn. In XPS, the laser-irradiated sample was found to be free of metal in the surface layer but contain metal in the lower layer. In XAFS, the laser-irradiated sample was found to contain metallic Cu in the surface layer. The surface layer of the laser-irradiated sample was free of metallic Fe as well, but contained semiconducting and insulating Fe components. In the lower layer, the proportion of $Fe^{2+}$ to $Fe^{3+}$ was higher than that in the entire sample. When ferrite is irradiated with a laser, the metal oxide in the ferrite is thermally decomposed and the metals in the exposed portions reduced. In this experiment, however, it seems that in the surface layer of the exposed portions part of the metals was reoxidized by residual heat (not to such an extent that the metals were sintered), whereas in the lower layer the metals remained reduced.

Figure 7:
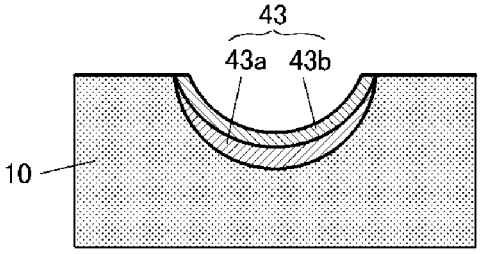
FIG. 7 is an enlarged cross-sectional view of an example of a low-resistance region.

FIG. 7 illustrates an example of a cross-sectional structure of a low-resistance region 43 formed in this way. The lower layer of the low-resistance region 43 is a reduced region 43*a*, in which the metals reduced from the metal oxide in the ferrite remain reduced, and the surface side of the low-resistance region 43 is a reoxidized coating 43*b*, which contains semiconducting and/or insulating components that are metal oxides resulting from reoxidation of the metals. The reduced region 43*a* and reoxidized coating 43*b* form the low-resistance region 43. The reoxidized coating 43*b* is not essential for the low-resistance regions 43, and it is possible to control the formation of the reoxidized coating 43*b* by performing the laser irradiation in a vacuum or a $N_2$ atmosphere, not in air.

The reoxidized coating 43*b*, if formed, may have the following advantages: $Fe_3O_4$ in the reoxidized coating 43*b* is not easily further reoxidized at room temperature. It therefore slows down the reoxidation of the underlying reduced region 43*a*, preventing the material from altering more than necessary, and limits the change in quality over time of the reoxidized coating 43*b*. The reoxidized coating 43*b* is a kind of semiconductor and its electrical resistance is lower than that of ferrite, which is an insulator. When the flange is electroplated, therefore, the reoxidized coating 43*b* can be used as a starting point for a layer of the plating metal to grow. It should, however, be noted that the formation of the metal thin-film section 55*a* is more efficient with low-resistance regions 43 having a reduced region 43*a* under the reoxidized coating 43*b*, owing to improved current density in such low-resistance regions 43 during electroplating.

FIGS. 8A to 8D illustrate another example of a process of the formation of the outer electrode 55, particularly one in which the lateral surface 52*a* of the flange 52 is densely irradiated with a laser L. The term "irradiate densely" means that the center-to-center distance D between the projected spots of laser light is substantially equal to or shorter than the aforementioned width W of the low-resistance regions 43. Under adjacent laser marks 40, therefore, the low-resistance regions are connected to one another (see FIG. 8B). Not all low-resistance regions 43 need to be connected. Because of dense irradiation, almost the entire reduced layer 52*c* on the lateral surface 52*a* of the flange 52 is occupied by low-resistance regions 43.

Figure 8A:
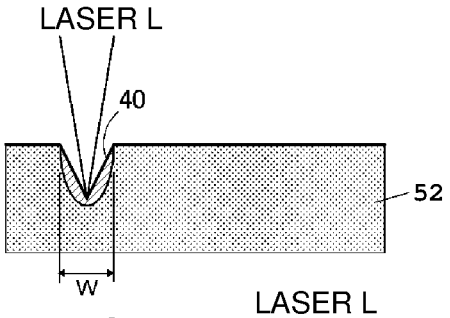
FIGS. 8A to 8D are cross-sectional diagrams illustrating another example of a process of the formation of an outer electrode.
Figure 8B:
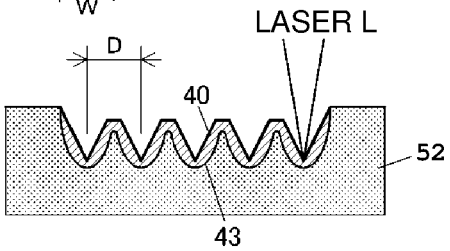
Figure 8C:
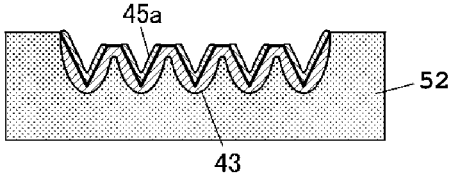
Figure 8D:
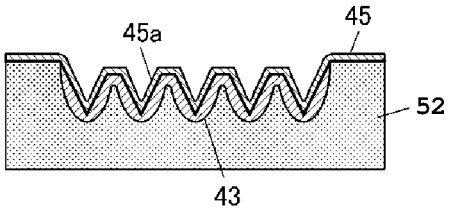

In this case, as illustrated in FIG. 8C, metal deposits 45*a* appear on the surfaces of the low-resistance regions 43 shortly after the start of plating. The metal deposits 45*a* are very close to each other and, therefore, adjacent metal deposits 45*a* join quickly. As a result, a continuous metal thin-film section 55*a* is formed faster than in the process illustrated in FIGS. 6A to 6D.

When the lateral surface 52*a* is densely irradiated with a laser L as in FIGS. 8A to 8D, the laser marks 40 are also densely created. The portion of the lateral surface 52*a* in which the reduced layer 52*c* has been formed is therefore recessed. Since the metal thin-film section 55*a* is formed in this recess in the lateral surface 52*a*, the surface of the metal thin-film section 55*a* can be substantially flush with or lower than the rest of the lateral surface 52*a*. This, together with the thinness of the metal thin-film section 55*a* itself, limits the thickness of the protruding portion of the outer electrode 55, further reducing the footprint.

Although the outer electrode 55 of the inductor 1 lies only on the lateral surface 52*a* and bottom surface 52*b* sides of the flange 52, the outer electrode 55 may be further formed on any other surface of the flange 52 (e.g., the surfaces that are in the front and back in FIG. 1). This adds little to the footprint, because it is possible to omit the base electrode section on that surface(s) by forming a metal thin film 55*a* there in the same way as on the lateral surface 52*a*.

Although the inductor 1 has one outer electrode on each flange, the outer electrode 54 on the flange 51 and the outer electrode 55 on the flange 52, there may be any number of outer electrodes on the flanges 51 and 52. For example, there may be two on each flange. That is, a wire-wound coil component according to an embodiment of the present disclosure can be a common-mode choke coil, a transducer, or any other coil component that has multiple wires 57.

Figure 9:
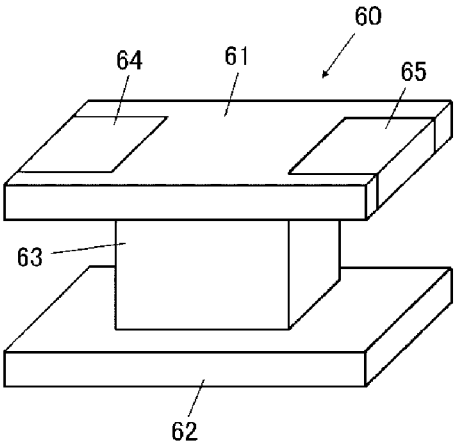
FIG. 9 illustrates a vertical coil component as a second example of a wire-wound coil component according to an embodiment of the present disclosure.

FIG. 9 illustrates a vertical inductor 2 of surface mount type as a second example of a wire-wound coil component according to an embodiment. The inductor 2 has a core 60 and outer electrodes 64 and 65. The core 60 has a spool 63 and two flanges 61 and 62 connected to the two end portions of the spool 63. The outer electrodes 64 and 65 have the same structure as the outer electrodes 54 and 55 of the inductor 1 but both extend from the top surface to a lateral surface of one flange, the flange 61, of the core 60. Around the spool 63 is wound a wire (not illustrated), the two end portions of which are connected one-to-one to the outer electrodes 64 and 65. When the inductor 2 is mounted onto a substrate, therefore, the top surface of the flange 61 in this drawing becomes the bottom surface, facing the substrate, and the lateral surfaces of the flange 61 come perpendicular to the substrate. That is, the inductor 2 differs from the inductor 1 in that the bottom surface, of the flange 61, is opposite the connection surface, at which the flange 61 is connected to the spool 63, and the lateral surfaces are located between the bottom and connection surfaces. Even this inductor 2 combines a reduced footprint and strengthened bonding with a substrate, similar to the inductor 1.

Although the inductor in FIG. 9 has two outer electrodes 64 and 65, here may be four or more outer electrodes on the flange 61 if two or more wires are used.

Figure 10:
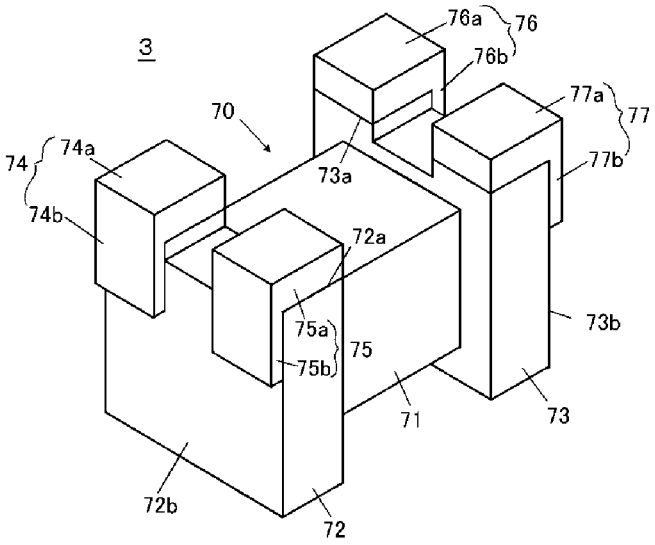
FIG. 10 illustrates a vertical coil component as a third example of an embodiment of the present disclosure.

FIG. 10 illustrates an example of a two-line common-mode choke coil as an application of a coil component according to an embodiment of the present disclosure. In FIG. 10, the coil component 3 is upside down. The core 70 of the coil component 3 has a spool 71 in the middle and a pair of flanges 72 and 73 at the ends of the spool 71 in the longitudinal direction. Around the spool 71 are wound two parallel wires (not illustrated). Each of the flanges 72 and 73 has two projections on its bottom surface side, and there are on these projections two outer electrodes 74 and 75 or 76 and 77 (a total of four). The two wires are connected and fastened at an end portion to the outer electrodes 74 and 75, on the flange 72, and at the other end portion to the outer electrodes 76 and 77, on the flange 73.

The top surfaces, in this drawing, of the projections of the flanges 72 and 73 are the bottom surfaces (mounting surfaces) 72*a* and 73*a* of the coil component 3, and the outer lateral surfaces of the flanges 72 and 73 are the lateral surfaces 72*b* and 73*b* of the component 3, which are perpendicular to the mounting surfaces. Each of the outer electrodes 74 to 77 is composed of a stack of a thick-film electrode section and a metal thin-film section, which is on the mounting surface side 74*a* to 77*a*, and a metal thin-film section, which is on the lateral surface side 74*b* to 77*b*. Owing to this structure, the connection between the end portions of the wires and the mounting surface side 74*a* to 77*a* of the outer electrodes 74 to 77 is highly reliable, and, when the coil component 3 is mounted onto a substrate, the bonding therebetween is strong. The flanges 72 and 73 are thinner on the lateral surface side 74*b* to 77*b* than on the mounting surface side 74*a* to 77*a*, hence a small footprint. In this arrangement, too, the heat and external force applied during the joining, by thermocompression bonding for example, of the end portions of the wires to the outer electrodes are absorbed by the base electrode sections, little transmitting to the flanges, since the end portions of the wires are connected to the mounting surface side 74*a* to 77*a* of the outer electrodes 74 to 77.

Although in the above examples the ceramic material for the core is ferrite, ferrite is not the only ceramic material that can be used. For example, alumina can be used instead. As long as the lateral surface side of the flanges, the side on which the metal thin-film section is formed, is made of a ceramic material containing a metal oxide, the spool and the other sides of the flanges can be made of a different material.

Although in the above examples electroplating is used, electroless plating can also be used. Even with electroless plating, it is possible to form the metal thin-film section selectively on the reduced layer, through a substitution reaction between the metals reduced from the metal oxide in the ceramic material with the metal in the plating bath. If electroless plating is used, the surface of the reduced layer may be treated with a catalyst so that the substitution reaction proceeds faster.

Although in the above examples localized heating is achieved by laser irradiation, other heating methods, such as irradiation with an electron beam and the use of an image furnace, can also be used. All of these alternatives are capable of focusing energy from a heat source and heating a particular site of the lateral surface of the flanges and, therefore, do not compromise the characteristics of the rest of the flanges.

In another variation, unlike the above examples, the laser light may be split to hit multiple sites at the same time.

Furthermore, the laser may be defocused so that the light hits a larger area than when the laser is focused.

Although in the above examples the metal thin-film section covers the base electrode section, the metal thin-film section only needs to lie on at least part of the reduced layer. Even in such a case, covering the metal thin-film and base electrode sections with any other element, such as first and second coatings, gives an outer electrode in which the metal thin-film and base electrode sections are united. Alternatively, the metal thin-film and base electrode sections may form separate electrodes, rather than being united. In such a case, the metal thin-film section serves as a dummy electrode, which strengthens the bonding of the coil component to a substrate by helping a solder fillet form.

Although in the above examples the metal thin-film section is formed by plating, other thin-film formation methods, such as sputtering and vapor deposition, can also be used. If any of these alternatives is used, the lateral surface of the flanges does not need to have the low-resistance regions and the reduced layer. It is, however, preferred to form a reduced layer including low-resistance regions first and then a metal thin-film section by plating. This would be more practical in terms of, for example, the availability of production equipment and the ease of performance of the process.

Although in the above examples the bottom surface side of the flanges has no low-resistance regions or reduced layer, low-resistance regions and a reduced layer may be formed on the bottom surface side before the formation of the base electrode section.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wire-wound coil component comprising:

a core having a spool and a flange connected to an end portion of the spool;

a wire wound around the spool; and an outer electrode to which an end portion of the wire is electrically coupled, wherein:

the flange has a lateral surface and a bottom surface; and the outer electrode has a metal thin-film section in contact with the lateral surface and a thick-film electrode section which is a metal composite film in contact with the bottom surface, the thick-film electrode section having a thickness greater than a thickness of the thin-film section, a portion of the thin-film section and a portion of the thick-film electrode section are each in direct contact with the lateral surface, a part of the lateral surface in contact with the thin-film section has a reduced layer including multiple low-resistance regions containing a reduced metal oxide, and the thin-film section has an end that is proximate to a location of an end of the reduced layer on the lateral surface.

2. The wire-wound coil component according to claim 1, wherein:

the flange contains a metal oxide; and the multiple low-resistance regions contain the reduced metal oxide resulting from reduction of a part of the metal oxide.

3. The wire-wound coil according to claim 2, wherein a surface side of the multiple low-resistance regions is a reoxidized coating and the reoxidized coating contains a metal oxide.

4. The wire-wound coil component according to claim 1, wherein:

the flange is made of a ceramic material containing a metal oxide; and the reduced layer contains the reduced metal oxide resulting from reduction of a part of the metal oxide.

5. The wire-wound coil component according to claim 1, wherein the end portion of the wire is connected to the outer electrode below the bottom surface.

6. The wire-wound coil component according to claim 1, wherein the thick-film electrode section is covered with the metal thin-film section.

7. The wire-wound coil component according to claim 1, wherein the bottom surface is a surface that faces a substrate and the lateral surface is a surface perpendicular to the substrate when the coil component is mounted onto the substrate.

8. The wire-wound coil component according to claim 1, wherein the lateral surface is opposite to a connection surface at which the flange is connected to the spool, and the bottom surface is positioned between the lateral surface and the connection surface.

9. The wire-wound coil component according to claim 1, wherein the flange is made of a ferrite material.

10. The wire-wound coil component according to claim 1, wherein the thin-film section extends further along the lateral surface than the thick-film electrode section.

11. A wire-wound coil component comprising:

a core having a spool and a flange connected to an end portion of the spool;

a wire wound around the spool; and an outer electrode to which an end portion of the wire is electrically coupled, wherein:

the flange has a lateral surface and a bottom surface; and the outer electrode has a metal thin-film section in contact with the lateral surface and a thick-film electrode section which is a metal composite film in contact with the bottom surface, the thick-film electrode section having a thickness greater than a thickness of the thin-film section, a portion of the thin-film section and a portion of the thick-film electrode section are each in direct contact with the lateral surface, and a part of the lateral surface in contact with the thin-film section has a reduced layer that is spaced from top and bottom surfaces of the flange, the reduced layer including multiple low-resistance regions containing a reduced metal oxide.

12. A wire-wound coil component comprising:

a core having a spool and a flange connected to an end portion of the spool;

a wire wound around the spool; and an outer electrode to which an end portion of the wire is electrically coupled, wherein:

the flange has a lateral surface and a bottom surface; and the outer electrode has a metal thin-film section in contact with the lateral surface and a thick-film electrode section which is a metal composite film in contact with the bottom surface, the thick-film electrode section having a thickness greater than a thickness of the thin-film section, a portion of the thin-film section and a portion of the thick-film electrode section are each in direct contact with the lateral surface, and a part of the lateral surface in contact with the thin-film section has a reduced layer that is spaced from an end of the thick-film section, the reduced layer including multiple low-resistance regions containing a reduced metal oxide.

13. A wire-wound coil component comprising:

a core having a spool and a flange connected to an end portion of the spool;

a wire wound around the spool; and an outer electrode to which an end portion of the wire is electrically coupled, wherein:

the flange has a lateral surface and a bottom surface; and the outer electrode has a metal thin-film section in contact with the lateral surface and a thick-film electrode section which is a metal composite film in contact with the bottom surface, the thick-film electrode section having a thickness greater than a thickness of the thin-film section, a portion of the thin-film section and a portion of the thick-film electrode section are each in direct contact with the lateral surface, and the thickness of the thin-film section is larger at an edge of the thick-film section where the thick-film section and the thin-film section directly contact the lateral surface and extends at that same thickness to a location proximate to a top surface of the flange.

* * * * *